United States Patent [19]

Hollinger

[11] Patent Number: 4,677,424

[45] Date of Patent: Jun. 30, 1987

[54] WINDOW SILL BURGLAR ALARM

[76] Inventor: Gus Hollinger, 4101 Slinker Rd., Little Rock, Ark. 72206

[21] Appl. No.: 691,868

[22] Filed: Jan. 16, 1985

[51] Int. Cl.[4] ..... G08B 13/08; H01H 3/16

[52] U.S. Cl. ..... 340/547; 200/61.81

[58] Field of Search ..... 340/547, 545, 549; 200/61.81

[56] References Cited

U.S. PATENT DOCUMENTS

| | | | |
|---|---|---|---|
| 3,641,540 | 2/1972 | Cutler et al. | 340/547 |
| 3,781,836 | 12/1973 | Kruper et al. | 340/547 X |
| 4,319,228 | 3/1982 | Daniels | 340/547 X |
| 4,438,430 | 3/1984 | Young et al. | 340/547 |

*Primary Examiner*—James L. Rowland
*Assistant Examiner*—Anne Marie F. Capati
*Attorney, Agent, or Firm*—Stephen D. Carver

[57] ABSTRACT

A concealable burglar alarm system for automatically generating a warning in response to either unauthorizd opening of a window or breakage of the associated window pane. The system includes a translucent, generally rectangular sending unit which is adapted to be permanently secured upon a window sill adjacent to a window being monitored. The sending unit includes a generally planar mounting base, and an associated magnetic reed switch having a stationary portion and a pivotally deflectable portion. Relative displacement between the reed switch moveable portion and the stationary portion causes an electrical circuit to close, activating a remotely disposed electronic circuit. The base of the sending unit preferably includes an integral, outwardly extending cylindrical projection upon which the coiled portion of a reed switch activation spring is mounted and flangeably secured. The spring includes a pair of outwardly extending first and second ends which are biased apart. The first end is preferably permanently coupled to a portion of the sending unit base, while the second spring end includes a tab portion adapted to be user-coupled to the moveable reed switch member enabling the sending unit and thus the alarm to be mechanically activated or deactivated by the user. A translucent linkage member adapted to be glued to the window pane extends downwardly into contact with the moveable portion of the reed switch to normally bias the sending unit to an "open circuit" condition. However, if the window pane is destroyed, or if the window is opened, the spring will in effect "close circuit" the reed switch and a suitable alarm, preferably disposed remotely from the window, will be activated in response thereto.

1 Claim, 6 Drawing Figures

WINDOW SILL BURGLAR ALARM

BACKGROUND OF THE INVENTION

The present invention relates generally to burglar alarms which generate a warning or alarm in response to unwanted intrusion. More specifically, the present invention relates generally to concealed burglar alarms typified by concealable sending units associated with windows to be monitored.

In the prior art a variety of approaches have been taken in the alarm technology to provide a warning against unauthorized intrusion. In general terms, such burglar alarms are adapted to sound a warning which may frighten away a surprised intruder, suitably alert the potential victim, or both. Usually such alarms tend to be bulky, difficult to operate, and in many cases, they are easily detected by professional thieves prior to effectuation of an unauthorized entry.

In the prior art a variety of sending units associated with such alarms have been proposed and it is known to provide magnetic reed switches for detecting unauthorized movement of windows, doors, or the like, whereby to generate a remote alarm. In U.S. Pat. No. 3,986,183 a burglar alarm generates a sound in response to the relative displacement of two magnets. A set and reset system is employed. U.S. Pat. No. 4,275,391 employs a pendulum with an attached magnet for effectuating an initial alarm. U.S. Pat. No. 4,292,629 is adapted to generate a signal through an electrical switch responsive to unauthorized displacement of a sliding glass door or screen door combination.

U.S. Pat. No. 3,706,090 issued to Callaghan on Dec. 12, 1972 is the closest art known to me. The burglar alarm of the aforesaid patent is for use on a window and it is activated by the breaking of a magnetic circuit across the window. However, I have found that with devices of the latter nature, professional thieves may easily discover them, and once the presence of such an alarm system is known by the would-be burglar, various routine acts of sabotage may be employed to gain unauthorized entry. Magnetic switches are also employed in the alarm systems of U.S. Pat. Nos. 4,438,430; 3,975,723; 4,160,972; 4,209,777 and 3,710,369.

The use of prior art burglar alarms known to me can be very difficult for the home consumer. For example, it is often very difficult to properly orient the sending unit in a convenient place which is easily accessible by the installer, but which is difficult to reach or circumvent by a burglar. Moreover, it is often difficult to associate some form of linkage member or the like with the window pane, the breakage or removal of which should activate the alarm system. Moreover, it will be readily apparent to those skilled in the art that alarm systems are normally disabled intentionally by the owner or user at a variety of times. For example, when it is desired to open various windows during cleaning or the like, the alarm should be temporarily disabled. This may occur during seasonal changes of the year, which may necessitate installation and subsequent removal of storm windows and the like.

In many prior art devices known to me, the system is deactivated electronically rather than mechanically. In other words, many times the consumer must actually adjust or disable the electronic units associated with the burglar alarm. I have found that it is much easier to simply disable the moving mechanical linkages. While many consumers can quickly grasp the operational concepts involved in a moving linkage, for example, many consumers have a great deal of difficulty in properly adjusting the associated electronic circuitry.

Hence, it would seem desirable to provide an easily concealable burglar alarm system which quickly and reliably detects intrusion through windows, but which may be conveniently disabled only by the user and without adjustment to associated electronic control circuitry.

SUMMARY OF THE INVENTION

The present invention comprises a concealable burglar alarm system adapted to be associated with a conventional window for automatically generating a warning in response to either unauthorized opening of the window or breakage of the window pane.

In the best mode of the invention the burglar alarm system includes a translucent, generally rectangular sending unit which is adapted to be permanently secured upon a window sill adjacent to a window being monitored. The sending unit includes a generally planar base, which may be permanently screwed into the window sill, and which facilitates flush mounting, as will hereinafter be described. Moreover, a magnetic reed switch associated with the base portion includes a stationary portion and a moveable portion, relative displacement between the moveable portion and the stationary portion causing an electrical circuit to close. The base of the sending unit preferably includes an integral, outwardly extending cylindrical projection upon which the coiled portion of an activation spring is mounted and flangeably secured. The spring is adapted to move one portion of the reed switch apart from the sending unit's stationary member, whereby to activate the associated electronic alarm apparatus.

Preferably the spring includes a coiled portion, as previously mentioned, which is integral with a pair of outwardly extending first and second ends which are biased apart. The first end is preferably permanently coupled to a portion of the sending unit base. However, the second end includes a tab portion adapted to be user-coupled to the moveable sending unit portion, whereby the sending unit may be mechanically activated or deactivated by the user.

A translucent linkage member is adapted to be glued to the window pane in operational contact with the sending unit. In other words, a suitable link, glued to the adjacent window pane extends downwardly into contact with the moveable portion of the reed switch to normally bias the sending unit to an "open circuit" condition. However, if the window pane is destroyed, or if the window is opened, the spring will cause the reed switch to activate and a suitable alarm, preferably disposed remotely from the window, will be activated.

The electrical alarm circuit contemplates a first electrical power supply normally powered by house current and a second battery powered energy supply for backing up the first power supply. Means are provided for coupling the electronic alarm generating means to a plurality of individual remotely disposed sending units of the character described. Moreover, it is desirable to provide means associated with the electronic circuit for distributing the alarm signal to a plurality of optionally remotely disposed transducers, including noise generators such as sirens and the like, and a variety of conventional lights.

Thus a broad object of the present invention is to reliably generate an intrusion alarm signal in response to unauthorized destruction or opening of a window.

A similar object of the present invention is to provide a concealable window still burglar alarm.

Another basic object of the present invention is to reliably warn the occupants of a dwelling of imminent unauthorized entry.

A still further object of the present invention is to provide a burglar alarm of the character described which may be easily and quickly mechanically set, or deactivated, by the user.

Similarly, it is an object of the present invention to provide a burglar alarm of the character described which cannot be deactivated by a would-be burglar.

Yet another object of the present invention is to provide a burglar alarm of the character described, the sending unit portion of which may be flush-mounted with respect to the window sill for purposes of concealment.

A still further object of the present invention is to provide a burglar alarm sending unit system which is very difficult to see from outside a dwelling in which the apparatus is installed.

Yet another object is to provide an electronic burglar alarm system of the character described, the electronic portions of which not be touched by the user for the purposes of setting or resetting the apparatus.

A related object is to provide an electronic system for a burglar alarm sending unit of the character described which is adapted, when activated, to activate one or more transducers.

A similar object of the present invention is to provide an electronic alarm system of the character described which is capable of providing suitable alarm signals in response to the activation of any one of a plurality of sending units of the character described.

A basic object of the present invention is to provide a burglar alarm system of the character described which may be quickly and easily installed by the user with a minimum degree of difficulty and with a minimal degree of electronic competence.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
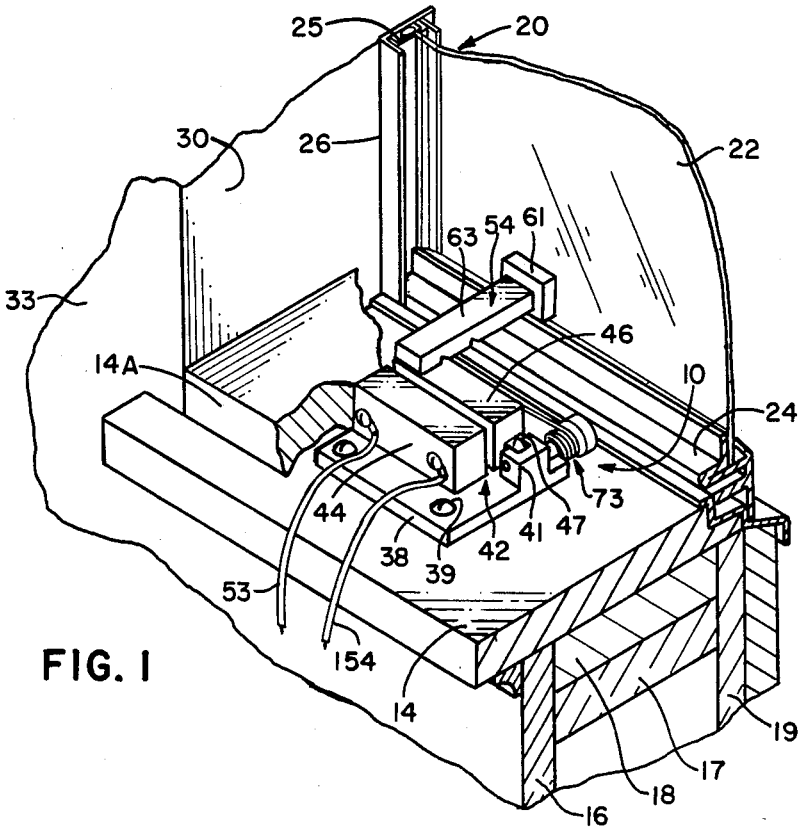
FIG. 1 is a fragmentary, isometric view of the sending unit of the present invention disposed in a preferred location adjacent a conventional window upon a conventional window sill.
Figure 2:
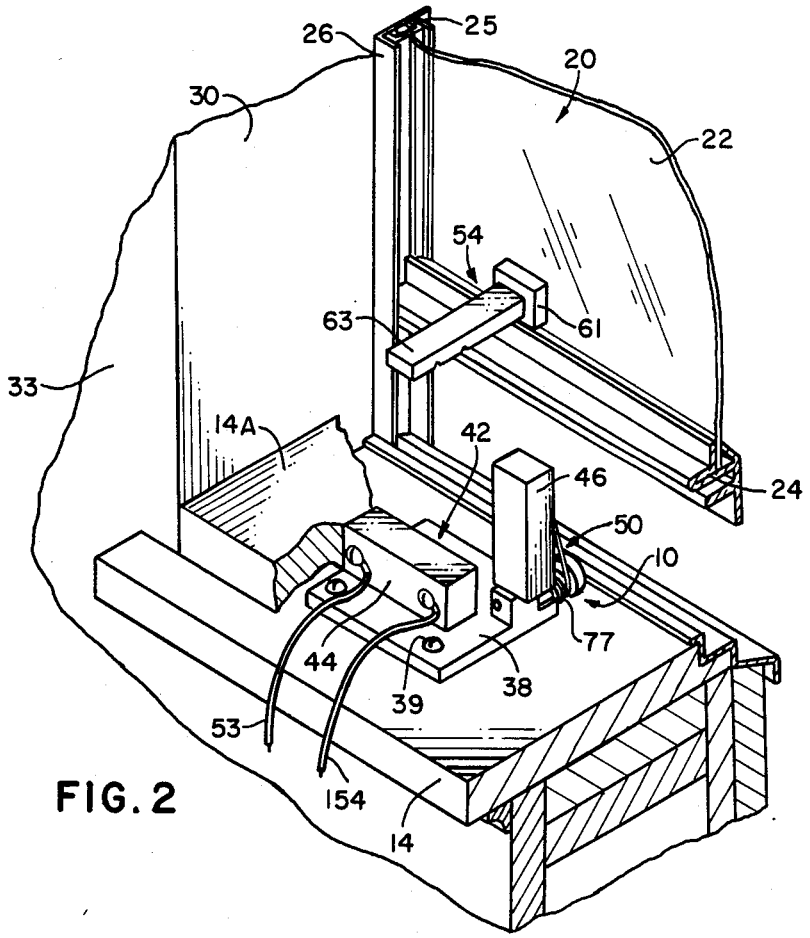
FIG. 2 is a view similar to FIG. 1, but illustrating activation of the sending unit in response to unauthorized opening of the associated window.
Figure 6:
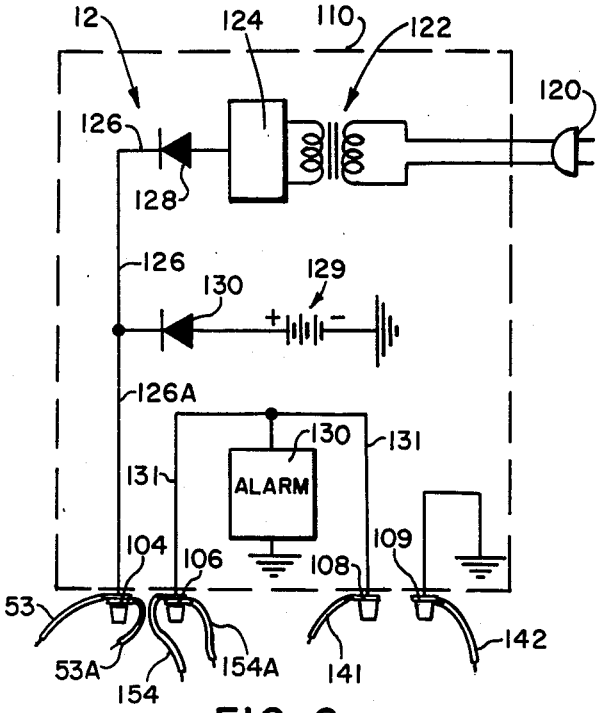

With initial reference directed now to FIGS. 1, 2 and 6, a window sill burglar alarm constructed in accordance with the best mode of the present invention comprises a sending unit generally designated by the reference numeral 10 (FIGS. 1, 2) and a remotely disposed electronic system, generally designated by the reference numeral 12 (FIG. 6). As best illustrated in FIGS. 1 and 2, the sending unit 10 is adapted to be mounted upon a window sill 14. Window sill 14 may be of generally planar, conventional dimensions, with a plurality of conventional structural braces 16 through 19 illustrated generally.

A window assembly, generally designated by the reference numeral 20, includes a conventional translucent pane of glass 22, captured within surrounding extruded aluminum edges 24, 25. The window assembly 20 is slidably mounted within the sash structure 26 in a conventional fashion. Prior to installation of the sending unit 10, the sill portion 14A may be opened with a suitable chisel or the like to provide for flush mounting of the sending unit 10 directly upon lower planar portion 14. The size of the sending unit is such that it is very difficult to see from outside the window (i.e., FIG. 3) and it is not in the way of the sides 30 of the window enclosure or the wall 33.

The sending unit preferably includes a generally planar base 38 which is adapted to be secured to the window sill portion 14 by a plurality of conventional screws 39. This base 38 includes a magnetic reed switch system generally designated by the reference numeral 42. The magnetic reed switch assembly 42 comprises a stationary portion 44 and an associated displaceable portion 46 which may be pivoted between the rest (i.e. open circuit) position illustrated in FIG. 1 and the vertically deflected (i.e. closed circuit) position illustrated best in FIG. 2. Movement or deflection of portion 46 is effectuated by spring means generally designated by the reference numeral 50 to be hereinafter described. Reed switch portion 46 includes an integral, apertured, rearwardly extending tab 47 pivotally secured within a suitable channel formed within mounting block 41 which is integral with base 38. As long as mechanical contact between a linkage member, generally designated by the reference numeral 54, and moveable sending unit portion 46 is made, the alarm will be in the "off" or "set" state. However, when sending unit portion 46 is "unblocked" so that it may pivot upwardly, an electrical circuit established within sending unit portion 44 provides a circuit path between conductors 53 and 154 which, as will hereinafter be described, are adapted to be extended to and coupled to the connecting posts of the electronic module 12 (FIG. 6).

The linkage means 54 is comprised of translucent plastic parts. It preferably includes a generally rectangular base 61 adapted to be glued to window pane 22 and a transversely outwardly extending portion 63 which is normally oriented substantially horizontally. When the window assembly is closed, and when the window pane is unbroken, linkage 54 will contact the sending unit portion 46 to maintain it in a horizontal position substantially in contact with base 38, and a circuit path between conductors 53 and 154 will not be established.

Thus it will be apparent if window pane 22 is broken such as to dislodge linkage 54 from its illustrated position, or if the window is pried open, as illustrated generally in FIG. 2, member 46 will flip upwardly, establishing a circuit path between lines 53 and 154 electrically coupled to the stationary sending unit portion 44. When this occurs, alarm system 12 will be activated as will hereinafter be described.

Figure 3:
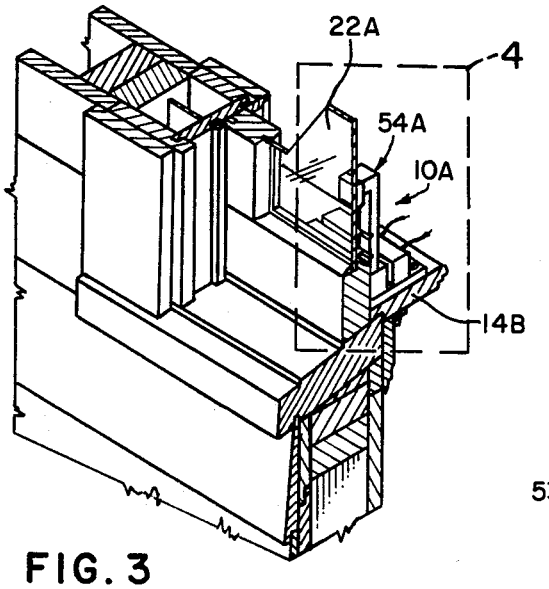
FIG. 3 is a fragmentary isometric view illustrating an alternative embodiment of the sending unit of the present invention, illustrating it substantially as it would appear from a vantage point outside the window thereshown.
Figure 4:
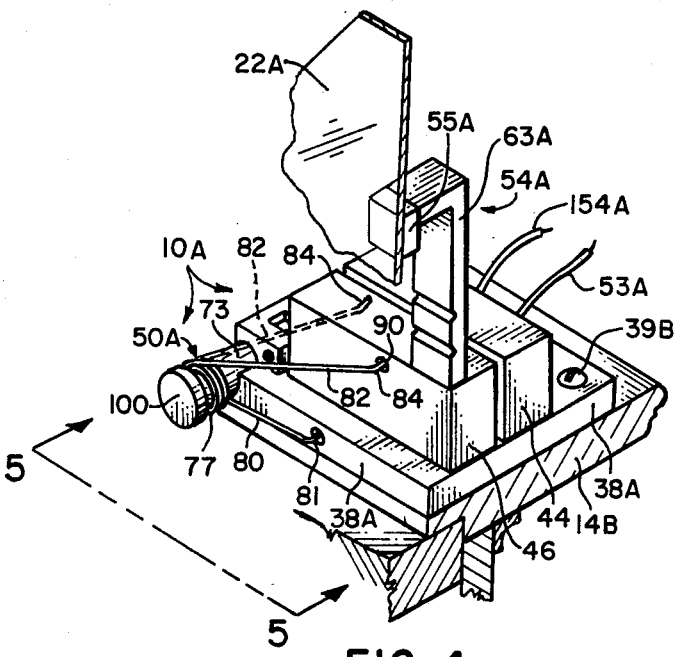
FIG. 4 is an enlarged, fragmentary isometric view, with portions thereof broken away or shown in section for clarity, illustrating the sending unit previously illustrated in less detailed form in the dashed line block numbered 4 in FIG. 3.
Figure 5:
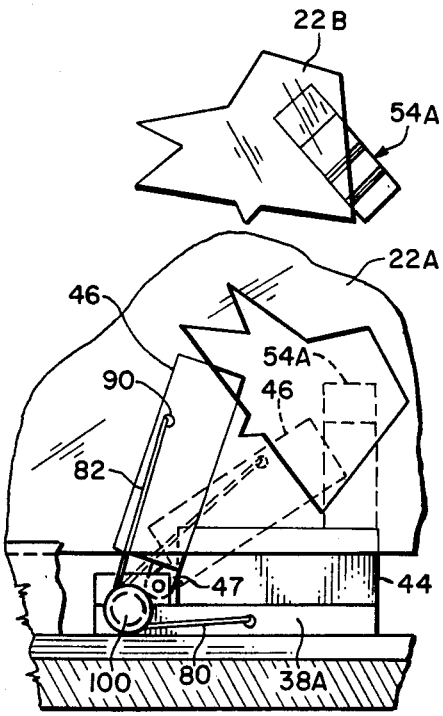
FIG. 5 is a fragmentary plan view taken generally along line 5—5 of FIG. 4, and illustrating a broken window pane; and, FIG. 6 is an electrical schematic diagram of the remote electronic activating network.

With reference now to FIGS. 3, 4, and 5, an alternative but similar sending unit 10A is shown employed in conjunction with an alternative window. Unit 10A includes a lower, planar base 38A secured by typical screws 39B to the window sill portion 14B. Sending unit 10A is virtually identical to unit 10 previously discussed, but it replaces linkage 54 with substantially vertically oriented, offset activating linkage 54A. Linkage 54A includes a base 55A, adapted to be glued to the window pane 22A, and a generally L-shaped downwardly extending offset elongated portion 63A which is adapted to physically contact the moveable portion 46 of the sending unit 10A. Thus, if window pane 22A is deflected or destroyed pivoted sending unit portion 46 will deflect upwardly, as is illustrated in FIG. 5, causing the alarm to activate.

Thus, if window pane 22A is broken, for example, (FIG. 5) a portion 22B of the broken window pane 24A will be deflected rearwardly and possibly fall interiorly of the dwelling, removing linkage 54A from contact with the moveable sending unit member 46. This unit will move from the horizontal position through the intermediate position shown in dashed lines in FIG. 5, to the illustrated substantially vertical position. When this occurs, an electrical contact will be made within the reed switch, and lines 53A, 154A will in effect be electrically shorted together.

With reference now primarily directed to FIGS. 1 and 4, either embodiment of the present invention includes an outwardly projecting, integral, cylindrical stem generally illustrated by the reference numeral 73, upon which the activating spring 50 or 50A is secured. Spring 50A and spring 50 are identical. Spring 50A includes a coiled portion 77 integral with a first terminal end 80 which is adapted to be permanently coupled to base 38A. End 80 terminates in a transverse portion 81 permanently affixed within a suitable aperture defined in the sending unit base. The second end 82 of spring 50 or 50A terminates in an integral transverse portion 84 adapted to be selectively secured within an orifice 90 (FIG. 4) defined in the moveable portion 46 of the reed switch. As best viewed in FIGS. 4 and 5, the central portion 77 of the aforesaid spring 50 (50A) is coaxially mated about projection 73 and it is retained in position by an outer flange 100. Importantly, this spring 50 or 50A normally urges its end 82 away from end 80. Thus, when installed, it will normally bias the moveable portion 46 of the sending unit upwardly away and out of contact with the stationary portion. Moreover, spring end 82 is biased laterally toward the reed switch assembly such that its transverse terminal end 84 naturally seeks to penetrate orifice 90 (FIGS. 4, 5).

When it is desired to mechanically enable the alarm system, the user need merely grasp spring end 82 and position it such that portion 84 thereof penetrates orifice 90. Similarly, when it is wished to deactivate the alarm, mere mechanical adjustment of spring end 82 and removal of transverse portion 84 thereof from orifice 90 will disenable the entire alarm circuit.

With reference now to FIG. 6, the preferred remote electronic means has been generally designated by the reference numeral 12. This system may include a variety of enclosures, generally designated by the reference numeral 110, which will include conventional bosses, couplings and the like for mounting internal circuitry. A plurality of post connectors, 104, 106, 108, and 109, are employed for connection of the circuit 12. Nominally 110-volt house current may be inputted to the apparatus through conventional plug 120, which voltage is stepped down by a conventional doorbell transformer 122. Reduced voltage alternating current reaching conventional rectifier circuit 124 results in positive voltage being applied to line 126 through isolation diode 128. An internal battery 129 is similarly coupled through an isolation diode 130 to line 126, such that terminal post 104 is normally energized via line 126A. If a short circuit develops across posts 104 and 106, alarm 130 will be activated via line 131. However, line 131 is electrically connected to terminal post 108, and terminal post 109 is internally grounded within housing 110. Hence, a plurality of remote alarm transducers may be activated by appropriate connection across lines 141, 142.

The terminal lines 53, 154 shown in FIG. 2 are adapted to be coupled via post connectors 104, 106 to enclosure 110 (FIG. 6). These post connectors facilitate the coupling of a variety of optional other sending units, such as sending unit 10A shown in FIGS. 3 through 5. Hence, activation lines 53A, 154A which originally emanate from embodiment 10A (FIGS. 4, 5) might also be connected to the alarm electronic circuit 12. Hence, the remotely disposed electronic circuit 12 may be employed and mounted by the user in any desired concealed position, as long as the activating or sensing wires 53, 53A, 154, and 154A, for example, are appropriately routed. Hence, the electronic module 12 may be employed with a plurality of sending units of the type described. In other words, post connectors 104, 106 may be secured to a plurality of connecting wires extending from a variety of sending units so that if any one of the sending units is activated, an appropriate alarm signal will be generated.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A concealable burglar alarm system adapted to be associated with a conventional window for detecting intrusions through or damage to the associated window pane, said system comprising:

a translucent sending unit adapted to be permanently, mounted upon and concealed with respect to the window sill or the like adjacent the glass window pane of said window, said sending unit comprising:

a base adapted to be mounted upon said sill;

a magnetic reed switch having a stationary portion and a moveable portion, the stationary portion adapted to establish a closed electrical path when said moveable portion is displaced from its normal rest position;

spring means adapted to normally torsionally bias said moveable portion from said rest position to an operationally displaced position whereby to activate said reed switch, said spring means including a coiled portion adapted to be coaxially mounted to a generally cylindrical projection integrally emanating from said sending unit base; a first end adapted to be permanently coupled to a portion of said base; and a second end biased upwardly with respect to said first end and biased toward said moveable portion of said reed switch by said coiled spring means portion; said generally cylindrical projection associated with said sending unit base including terminal flange means for axially capturing said coiled portion of said spring means;

concealable translucent linkage means adapted to be user secured to at least a portion of said window pane for contacting and urging said moveable portion of said reed switch towards its rest position against predetermined pressure from said spring means to maintain said system in a "set" state when said window is substantially closed and/or the window pane is unbroken; said linkage means operable to disengage from said moveable portion of said reed switch when said window is broken or opened whereby said spring means will rotate said reed switch moveable portion;

remote electronic means coupled to said sending unit for generating an alarm signal in response to activation of said reed switch, wherein said remote electronic means includes:

a first electrical power supply adapted to power the electronic means from normal house current;

second internal battery power supply for backing up said first power supply;

means for coupling said electronic means to a plurality of individual remotely disposed sending units; and, means for distributing said alarm signal to a plurality of optional remotely disposed transducers; and, wherein said second end of said spring means includes a terminal transverse portion adapted to be removably inserted within an orifice defined in said reed switch moveable portion whereby said alarm means may be quickly mechanically deactivated by the user when he wishes the alarm system to be inoperable, without disturbing or adjusting said remote electronic means.

* * * * *